US005207211A

United States Patent [19]

Hanning et al.

[11] Patent Number: 5,207,211

[45] Date of Patent: May 4, 1993

[54] MULTIPLE U-TUBE DOWN FIRED WATER HEATER

[75] Inventors: David M. Hanning; Gordon W. Stretch, both of Montgomery, Ala.

[73] Assignee: Rheem Manufacturing Company, New York, N.Y.

[21] Appl. No.: 881,161

[22] Filed: May 11, 1992

Related U.S. Application Data

[63] Continuation-in-part of Ser. No. 862,292, Apr. 2, 1992.

[51] Int. Cl.[5] ..... F24H 1/20

[52] U.S. Cl. ..... 126/360 R; 122/17; 122/33

[58] Field of Search ..... 122/17, 19, 14, 121, 122/32, 33, 75, 45; 126/360 R

[56] References Cited

U.S. PATENT DOCUMENTS

| | | | |
|---|---|---|---|
| 2,495,673 | 1/1950 | Erwin | 126/360 |
| 2,543,835 | 3/1951 | Dewey | 126/360 |
| 4,329,943 | 5/1982 | Schwörer | 122/17 |
| 4,380,215 | 4/1983 | Mendelson | 122/13 R |
| 4,445,464 | 5/1984 | Gerstmann et al. | 122/16 |
| 4,492,185 | 1/1985 | Kandall et al. | 122/32 |
| 4,651,714 | 3/1987 | Granberg | 126/378 |
| 4,685,425 | 8/1987 | Eising | 122/17 |
| 4,699,122 | 10/1987 | Jannemann et al. | 126/362 |
| 4,938,204 | 7/1990 | Adams | 126/360 R |
| 5,069,169 | 12/1991 | Maruko | 122/33 |

*Primary Examiner*—Edward G. Favors
*Attorney, Agent, or Firm*—Konneker & Bush

[57] ABSTRACT

The top storage tank end wall of a down-fired water heater has a first circumferentially spaced series of circular openings formed therethrough and centered about the tank axis, and a second circumferentially spaced series of circular openings centered about the tank axis and spaced radially outwardly of the first series of openings. Vertically disposed within the tank is a circumferentially spaced series of hollow U-tube immersion heating members each having a first open upper end secured to one of the first series of openings, and a second open upper end secured to one of the second series of openings. Shot-type fuel burners extend downwardly into the second open upper tube ends and are supplied with gaseous fuel via a manifold ring positioned atop the water heater. Hot combustion gases from the burners are drawn through the U-tubes by a draft inducer fan having an inlet connected to the first open upper ends of the tubes. In an alternate embodiment of the water heater, air-driven power fuel burners are connected to the first open upper tube ends and are supplied with driving air through a manifold structure connected to the outlet of a supply air blower. Combustion gases forced out the second tube ends are collected in an exhaust manifold structure for venting to atmosphere.

14 Claims, 2 Drawing Sheets

MULTIPLE U-TUBE DOWN FIRED WATER HEATER

CROSS-REFERENCE TO RELATED APPLICATION

The present application is a continuation-in-part of U.S. application Ser. No. 862,292 filed on Apr. 2, 1992 and entitled "DOWN FIRED U-TUBE WATER HEATER".

BACKGROUND OF THE INVENTION

The present invention relates generally to heating apparatus, and more particularly relates to fuel-fired water heating appliances such as water heaters and boilers.

Conventional fuel fired water heaters are typically provided with "up-flow" firing configurations in which upper and lower tube sheet structures are secured at the top and bottom ends of the metal storage tank portion of the water heater. The open upper and lower ends of a spaced series of submerged vertical heating flues are respectively secured to these upper and lower tube sheets and receive an upward throughflow of hot combustion gases generated by a fuel burner structure disposed beneath the lower tube sheet. These upwardly flowing combustion gases serve to heat water stored in the tank for on-demand outflow therefrom to the various plumbing fixtures served by the water heater. The combustion gases upwardly exiting the vertical flues are discharged to ambient through a suitable vent pipe.

Despite the wide acceptance and use of this up-flow configuration in fuel-fired water heaters, it presents a variety of well known problems, limitations and disadvantages. For example, the single upward pass of hot combustion gases through the tank water tends to provide a relatively low combustion gas-to-water heat exchange efficiency rate.

Additionally, various fabricational complexities associated with conventional upflow water heaters tend to undesirably add to their overall manufacturing cost. As an example, the necessity of providing both top and bottom tube sheets requires that numerous welds be formed to operatively secure both the top and bottom ends of the flues to their associated tube sheets. Moreover, the presence of the bottom tube sheet complicates the formation of the usual outer jacket insulation structure that encapsulates the storage tank. During the placement of the insulation around the tank, auxiliary insulation stop structures must typically be utilized. Also, a bottom skirt structure is normally required in conjunction with the bottom end burner used in these upflow water heaters.

In response to these problems associated with upflow water heaters, various solutions have heretofore been proposed in the prior art, including the construction of water heaters in down-flow configurations in which the burner is mounted on the top of the water heater, and the hot combustion gases generated by the top-mounted burner are downwardly flowed through a series of vertical flues submerged within the storage tank. While this reversed configuration typically positions the burner on top of the tank, it still requires considerable welding since both an upper tube sheet and a lower tube sheet are needed. Additionally, insulation stops are still required, due to the presence of the lower tube sheet, and the single pass of hot combustion gases through the tank water keeps the overall combustion gas-to-water heat exchange efficiency at a relatively low level.

Another approach used in the prior art in an attempt to reduce the various problems associated with upflow firing configurations in water heaters is to provide what may be designated a horizontal, multi-pass firing configuration. Under this approach, a multi-pass immersion heater structure is extended horizontally into the storage tank interior through an side wall opening formed therein, and the burner is mounted on an exterior side portion of the water heater. The immersion heating structures used in this approach tend to be rather complicated from a manufacturing standpoint, and the overall heating structure still tends to interfere with the jacket insulation forming process. Additionally, the heat input to the tank water tends to be undesirably concentrated in a vertically intermediate portion of the tan interior.

Yet another approach attempted in the prior art, illustrated in the 1945 Dewey U.S. Pat. No. 2,543,835, is to provide a down fired, multi-pass immersion heating structure in which the hot combustion gases downwardly enter and then upwardly exit the tank interior. The Dewey immersion heating structure is removably secured to the upper end of a liquid heating vessel and comprises a spaced pair of vertical inlet and discharge flues connected at their lower ends to rectangular header boxes that are joined by a plurality of rectangularly cross-sectioned horizontal flues. The upper end of the inlet flue is connected to a burner structure, and the upper end of the discharge flue is connected to the inlet of a suction fan.

Despite its top burner mounting and multi-pass combustion gas flow routing, the Dewey immersion heater structure is not well suited for use in modern mass produced residential or commercial water heaters for a variety of reasons. For example, the headered immersion heater structure is of a relatively complicated (and thus expensive) configuration requiring that several welding steps be performed to operatively interconnect the necessary cylindrical inlet and discharge flues, the rectangular headers, and the multi-channel horizontal bottom flue structure. Also, the multi-piece nature of the Dewey immersion heater structure undesirably places a series of heater joints within the liquid vessel. Furthermore, the heater structure is designed to be removed for cleaning, thereby requiring a dual flanged interconnection between a top end portion of the liquid vessel and the flat top plate to which the immersion heater structure is secured.

It can be seen from the foregoing that a need exists for an improved fuel fired water heater that is simpler, less expensive to manufacture and more fuel efficient than conventional upflow water heaters, and that also eliminates or at least substantially reduces the problems, limitations and disadvantages typically associated with prior art alternatives to upflow water heaters. It is accordingly an object of the present invention ti provide such an improved fuel fired water heater.

SUMMARY OF THE INVENTION

In carrying out principles of the present invention, in accordance with a preferred embodiment thereof, a uniquely constructed down-fired water heater is provided which may be relatively inexpensively manufactured and yields a desirably high combustion product-to-water heat exchange efficiency with the combustion heat being evenly distributed to the water within the storage tank portion of the heater.

The internal heat transfer portion of the water is defined by a circumferentially spaced series of vertical hollow U-tube immersion heating members disposed within the interior of the water heater storage tank. Each of the U-tubes is preferably formed from a single length of metal tubing and has a curved lower end spaced upwardly apart from the bottom end of the tank. A first circumferentially spaced series of circular openings, centered about the vertical tank axis, are formed through the top end of the storage tank radially inwardly of a second circumferentially spaced series of circular openings formed through the top tank end and also centered about the vertical axis of the tank.

First open upper ends of the U-tubes are secured within the first series of circular tank end openings, with the second open upper ends of the U-tubes being secured within the second series of circular tank end openings. In a preferred embodiment of the water heater, the first series of openings are generally aligned, in a circumferential sense, with the second series of openings in the upper tank end wall. Accordingly, the leg to leg horizontal dimension of each of the vertical U-tubes within the water heater storage tank extends generally radially relative to the vertical axis of the storage tank.

In one illustrated embodiment of the water heater, a circumferentially spaced series of shot-type fuel burners extend downwardly into the second open upper ends of the U-tubes and are supplied with gaseous fuel via an annular gas manifold centered about the tank axis and disposed above the top end of the water heater. During operation of the water heater, the burners direct flames, and resulting hot combustion gases, downwardly into the second open upper ends of the U-tubes. The combustion gases are drawn through the U-tubes, and outwardly through their first open upper ends, by a draft inducer fan having an inlet connected to the first open upper tube ends through a generally cylindrical exhaust manifold structure positioned atop the water heater to receive the combustion gases exiting the U-tubes.

In another illustrated embodiment of the water heater the forced draft flow of hot combustion gases through the U-tubes is achieved using air-driven power burners operatively connected to the first open upper ends of the tubes and supplied with pressurized combustion air through a manifold structure mounted atop the water heater and connected to the outlet of a supply air blower. Combustion gases forced out the second open upper tube ends by operation of the power burners is collected in an annular exhaust manifold structure for forced discharge to atmosphere through a suitable vent pipe connected to the exhaust manifold structure.

The use of the vertical U-tubes within the storage tank interior eliminates the necessity, encountered in conventional up-flow water heater configurations, of welding immersion heating members to both the top and bottom end portions of the tank structure, thereby reducing the overall manufacturing cost of the water heater. Additionally, the heat exchange efficiency of the water heater is significantly increased since the burner combustion gases are caused to make two passes through the tank water before being vented to atmosphere. Moreover, the combustion heat is very evenly distributed to the tank water, both vertically and horizontally, due to the circumferentially spaced positioning of the vertical U-tubes within the tank.

DETAILED DESCRIPTION

Figure 1:
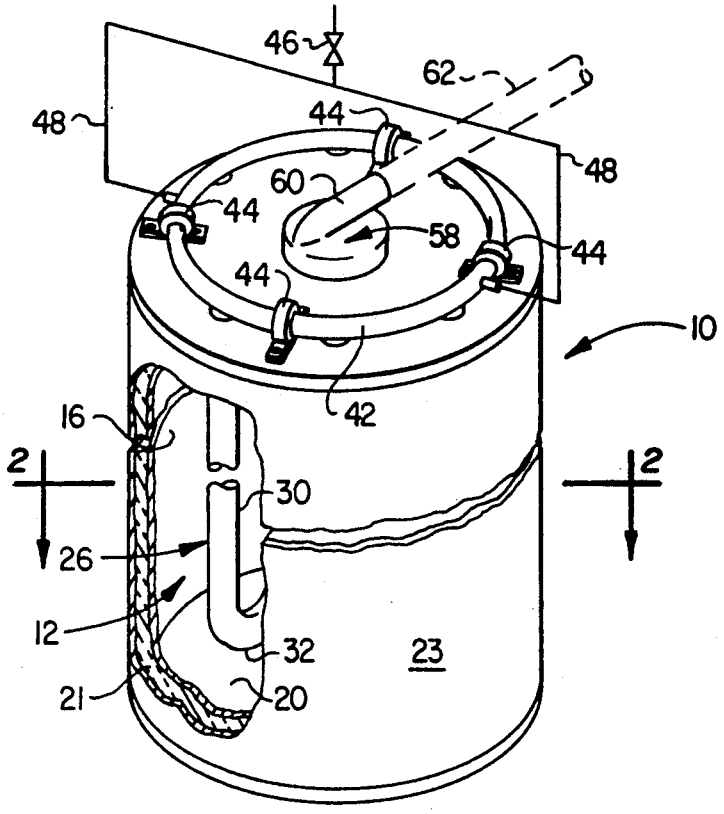
FIG. 1 is a vertically foreshortened, partially cut away simplified perspective view of a multiple U-tube down fired water heater embodying principles of the present invention.
Figure 2:
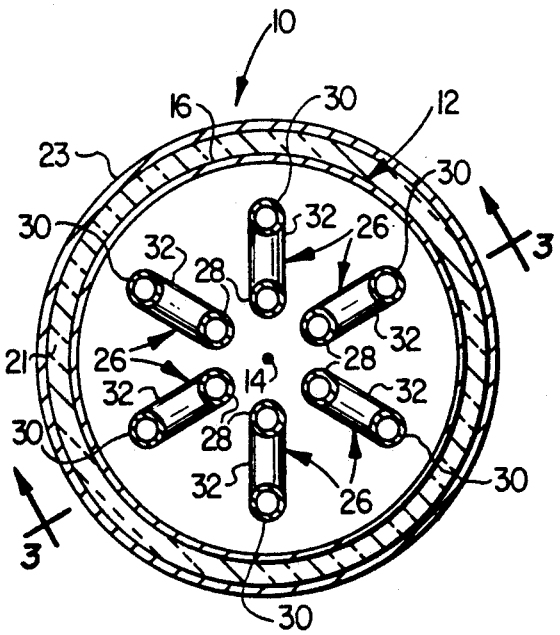
FIG. 2 is a cross-sectional view through the water heater taken along line 2≦2 of FIG. 1.
Figure 3:
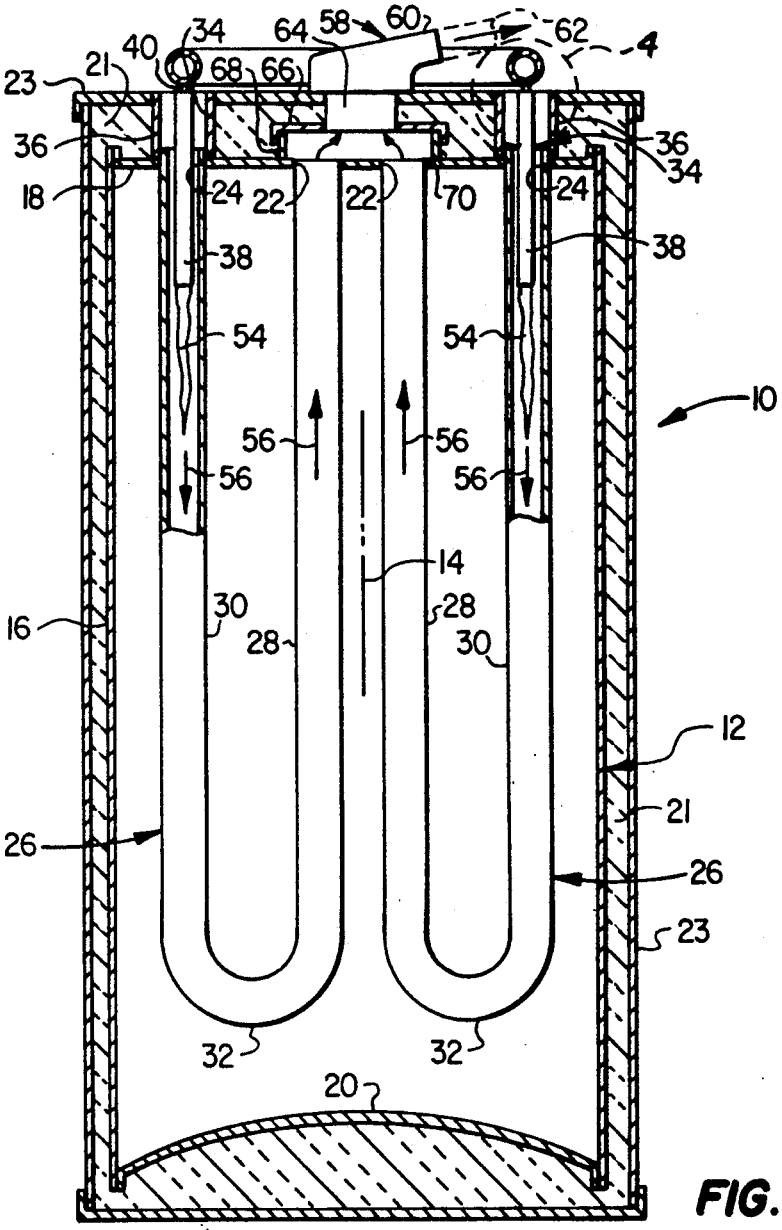
FIG. 3 is an enlarged scale cross-sectional view through the water heater taken along line 3—3 of FIG. 2, with two of the U-tube immersion heating members having been deleted for illustrative clarity.

Illustrated in somewhat simplified form in FIGS. 1–3 is a down-fired water heater 10 embodying principles of the present invention. The water heater 10 includes a cylindrical metal water storage tank 12 that longitudinally extends along a vertical axis 14. Tank 12 has an open-ended cylindrical body 16, a generally flat top end wall 18 (see FIG. 3) welded within the upper end of body 16, and an upwardly domed bottom end wall 20 welded within the lower end of body 16. The storage tank 12 is externally covered with a suitable insulation material 21 disposed between the tank 12 and an external jacket structure 23.

A first series of six circumferentially space circular openings 22 are formed through the top tank end wall 18 and are centered about the tank axis 14. Spaced radially outwardly of the openings 22 are a series of six circumferentially spaced circular openings 24 also formed through the top tank end wall 18 and centered about the axis 14. The six openings 24 are circumferentially aligned with the six openings 22.

The illustrated water heater 10 also includes six elongated U-tube immersion heating members 26, each of which is preferably formed from a single length of metal tubing. The tubes 26 (two of which have been deleted in FIG. 3 for illustrative clarity) are vertically disposed within the interior of tank 12 and are circumferentially spaced apart in a circular array centered about the tank axis 14. Each of the tubes 26 has a first vertically extending leg 28 with an open upper end, a second vertically extending leg 30 with an open upper end, and a curved, closed bottom end 32 spaced upwardly a short distance from the bottom tank end wall 20.

The open upper ends of the tube legs 28 are upwardly received and welded within the openings 22 in the top tank end wall 18, and the open upper ends of the tube legs 30 are upwardly received and welded within the openings 24 in the top tank end wall 18. Accordingly, the leg 30 of each of the tubes 26 is generally radially outwardly offset from its other leg 28 as may best seen in FIG. 2.

Figure 4:
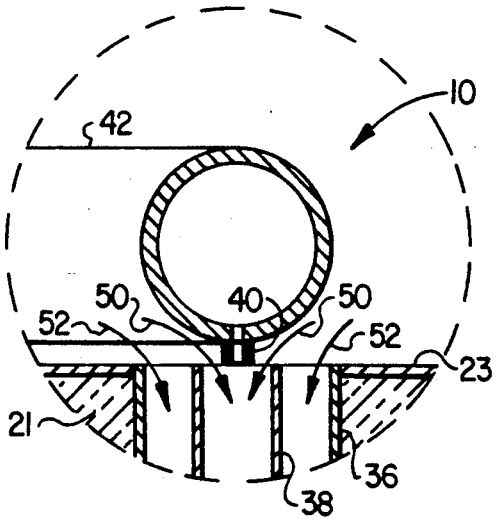
FIG. 4 is an enlargement of the circled area "4" in FIG. 3.

Referring now to FIGS. 1 and 3, six circumferentially spaced openings 34 extend downwardly through the top end of the outer jacket structure 23 and the insulation 21 at the top end of the tank 12. Openings 34 are aligned with the top end wall openings 24 and are lined with metal collar members 36. Upper end portions of cylindrical shot-type fuel burners 38 (see FIG. 4 also) having diameters smaller than those of collars 36 are suitably supported concentrically within the collars 36, with the lower ends of the burners 38 extending downwardly into the open upper ends of the tube legs 30 as best illustrated in FIG. 3.

Gaseous fuel is supplied to the upper ends of the burners 38 through gas discharge orifice members 40 supported on the bottom side of a generally ring-shaped gas supply manifold 42 supported in an elevated relationship with the top end of the water heater 12 by suitable clamps 44 (see FIG. 1). A gas valve 46 connected in supply piping 48 attached to the manifold 42 is operable to flow pressurized gaseous fuel from a source thereof into the manifold for discharge from the orifice members 40 into the top end of the burners 38.

During firing of the burners 38, primary ambient combustion air 50, is drawn into the top ends of the burners 38 from around the orifice members 40 (see FIG. 4), while secondary ambient combustion air 52 from beneath the ring manifold 42 is drawn downwardly into the annular areas defined between the burners 38 and the collars 36. As illustrated in FIG. 3, the burner flames 54, and the resulting hot combustion gases 56, are directed downwardly into the tube legs 30 and originate at points spaced downwardly apart from the upper tank end wall 18.

A forced draft flow, downwardly through the tube legs 30 and then upwardly through the tube legs 28, by a draft inducer fan 58 (see FIGS. 1 and 3) centrally mounted on the upper end of the water heater 10 and having an outlet 60 connected to a suitable vent pipe 62. The inlet 64 of the draft inducer fan 58 is connected to an opening in the top wall 66 of a generally inverted pan-shaped collector structure 68. The bottom peripheral edge of the open lower side of the collector structure 68 is sealed, as at 70, to the top side of the top tank end wall 18 outwardly around the open upper ends of the tube legs 28. Accordingly, during firing of the water heater 10, the combustion gases 56 are drawn upwardly into the collector structure 68, through the open upper ends of the tube legs 28, and then exhausted into the vent pipe 62 by the draft inducer fan 58.

The illustrated down-fired water heater 10 offers a variety of structural and operational advantages over conventional up-fired water heaters. For example, the hot combustion gases 56 generated by the burners 38 are forced to make two passes through each of the U-tubes 26 before being discharged to atmosphere via the vent pipe 62. Compared to the traditional single pass of hot combustion gas through the tank water being heated, this significantly increases the fuel use efficiency of the water heater 10.

Additionally, the water heater 10 is less expensive to fabricate since the immersion heating elements (i.e., the tubes 26) do not have to be welded to a bottom portion of the water heater—they only have to be welded at the top end thereof. Further, the U-tubes 26 (of which there may be a greater or lesser number than the six illustratively depicted) provide for very even heating of the tank water. This desirable evenly distributed heating of the tank water occurs vertically along the tank interior and, due to the circumferentially spaced orientation of the U-tubes 26, is provided circumferentially around the tank interior as well.

Figure 5:
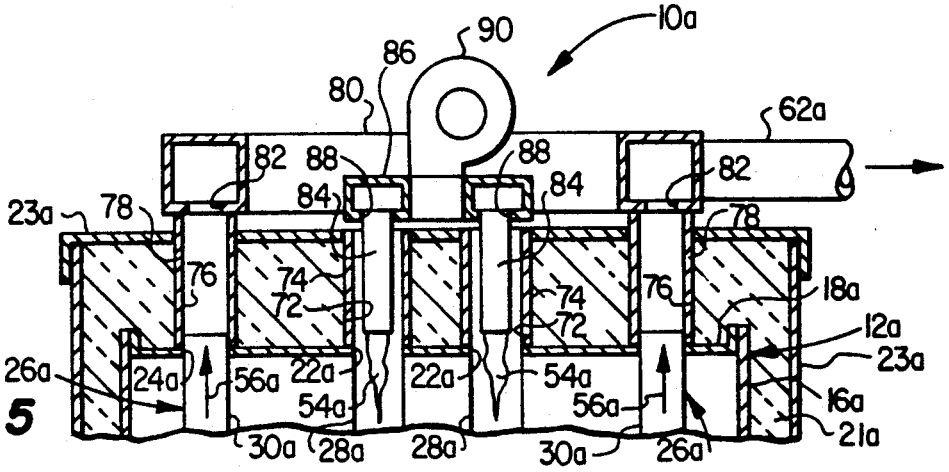
FIG. 5 is a simplified cross-sectional view through a top end portion of an alternate embodiment of the water heater.

A top end portion of an alternate embodiment **10*a* of the previously described down-fired water heater 10 is cross-sectionally illustrated in simplified form in FIG. 5. For ease in comparison between the water heaters 10*a* and 10, components in the heater 10*a* similar to those in the heater 10** have been given the same reference numerals to which the subscripts "a" have been added.

In the water heater **10*a*, circular openings 72 are extended upwardly from the top tank end wall openings 22*a* through the insulation 21*a* and the top end of the jacket structure 23*a*, and are lined with metal collars 74. In a similar manner, circular openings 76 are extended upwardly from the top tank end wall openings 24*a* through the insulation 21*a* and the top end of the jacket structure 23*a* and are lined with metal collars 78. The open upper ends of the collars 78 are secured to the underside of an annular exhaust manifold structure 80 over bottom side openings 82 therein. Manifold 80, in turn, is connected to a suitable vent pipe 62*a***.

Air-driven powered fuel burners 84 are concentrically supported in the collars 74 and have smaller diameters than such collars, thereby permitting the inflow of ambient secondary combustion air as previously described in conjunction with the shot-type burners 38. The upper inlet ends of the burners 84 are suitably supplied with gaseous fuel (via non-illustrated fuel supply piping) and are connected to the underside of an annular air supply manifold structure 86 over bottom side openings 88 therein. The outlet of a supply air blower 90 is communicated with the interior of the manifold structure 86 so that during firing of the burners 84, pressurized primary combustion air is forced into the burners via the manifold 86.

This combustion air is mixed with the delivered fuel and ignited, thereby creating burner flames **54*a*, and resulting hot combustion gases 56*a*, which are forced downwardly into the U-tube legs 28*a*. Because of the positive burner pressure created by the blower 90, the combustion gases 56*a* are sequentially forced downwardly into the tube legs 28*a*, upwardly through the tube legs 30*a* into the manifold 80, and then outwardly through the vent pipe 62*a* to atmosphere. In this manner, a forced draft flow of combustion gases is moved, in two passes, through each of the U-tube immersion heating members 26*a***.

The foregoing detailed description is to be clearly understood as being given by way of illustration and example only, the spirit and scope of the present invention being limited solely by the appended claims.

What is claimed is:

1. A down fired water heater comprising:

a tank for storing water, said tank extending a vertical axis and including a top end wall having a first plurality of openings circumferentially spaced about said axis, a second plurality of openings circumferentially spaced about said axis horizontally outwardly of said first plurality of openings, and a bottom end wall spaced downwardly apart from said top end wall along said axis;

a plurality of U-tube immersion heating members disposed within the interior of said tank and circumferentially spaced around said axis, each of said plurality of U-tube immersion heating members having:

a curved lower end spaced upwardly apart from said bottom end wall, a first leg portion extending upwardly from said curved lower end and having an open upper end connected to one of said first plurality of openings in said top end wall of said tank, and a second leg portion extending upwardly from said curved lower end and having an open upper end connected to one of said second plurality of openings in said top end wall of said tank;

a spaced series of fuel burner means disposed at the top of said tank and operative to receive air and fuel from sources thereof and responsively direct flames, and resulting hot combustion gases, downwardly into said open upper ends of one of the pluralities of first and second leg portions of said U-tube immersion heating members;

first plenum means positioned above said top end wall of said tank and operative to receive gaseous fuel from a source thereof and deliver the received gaseous fuel to said spaced series of fuel burner means;

second plenum means positioned above said top end wall of said tank and operative to receive combustion gases discharged from said open upper ends of the other of the pluralities of first and second leg portions of said U-tube immersion heating members, said second plenum means having an outlet opening; and forced draft means for forcibly flowing said combustion gases from said burner means sequentially through said U-tube immersion heating members, into said second plenum means, and outwardly through said outlet opening of said second plenum means.

2. The down-fired water heater of claim 1 wherein:

each of said U-tube immersion heating members is formed from a single length of metal tubing.

3. The down-fired water heater of claim 2 wherein:

each of said single lengths of metal tubing has a circular cross-section along its length.

4. The down-fired water heater of claim 1 wherein:

said spaced series of fuel burner means are operative to direct flames, and resulting hot combustion gases, downwardly into said open upper ends of said second leg portions of said U-tube immersion heating members, said second plenum means are operative to receive combustion gases discharged from said open upper ends of said first leg portions of said U-tube immersion heating members, and said forced draft means include a draft inducer fan having an inlet connected to said outlet opening of said second plenum means.

5. The down-fired water heater of claim 4 wherein:

said spaced series of fuel burner means are shot type burners extending downwardly into said open upper ends of said first leg portions of said U-tube immersion heating members and having open upper ends, and said first plenum means outwardly circumscribe said second plenum means and have inlet means for receiving pressurized gaseous fuel from a source thereof, and a spaced series of outlet openings aligned with and positioned above said open upper ends of said shot-type burners.

6. The down-fired water heater of claim 5 wherein:

said first plenum means are elevated relative to said open upper ends of said shot type burners to permit ambient primary combustion air to be drawn past said first plenum means into said open upper ends of said shot type burners during operation of said down-fired water heater.

7. The down-fired water heater of claim 6 further comprising:

wall means for defining open-topped upward extensions of said open upper ends of said second leg portions of said U-tube immersion heating members, said extensions coaxially and outwardly circumscribing upper end portions of said shot type burners and being configured to permit ambient secondary combustion air to be drawn downwardly therethrough, around said shot type burners and into said open upper ends of said second leg portions of said U-tube immersion heating members, during operation of said down-fired water heater.

8. The down-fired water heater of claim 5 wherein:

said second plenum means are defined by a generally inverted pan-shaped plenum structure having a peripheral side wall with a bottom edge portion secured to the upper side surface of said top end wall of said tank and outwardly circumscribing said open upper ends of said first leg portions of said U-tube immersion heating members, said plenum structure having a top end wall in which said outlet opening of said second plenum means is formed, said first plenum means are defined by a hollow, generally ring-shaped plenum structure circumscribing said axis, and said outlet openings of said first plenum means are defined by a circumferentially spaced plurality of gas discharge orifices operatively carried on the underside of said generally ring-shaped plenum structure.

9. A down fired water heater comprising:

a tank for storing water, said tank extending along a vertical axis and including a top end wall having a first plurality of openings circumferentially spaced about said axis, a second plurality of openings circumferentially spaced about said axis horizontally outwardly of said first plurality of openings, and a bottom end wall spaced downwardly apart from said top end wall along said axis;

a plurality of U-tube immersion heating members disposed within the interior of said tank and circumferentially spaced around said axis, each of said plurality of U-tube immersion heating members having:

a curved lower end spaced upwardly apart from said bottom end wall, a first leg portion extending upwardly from said curved lower end and having an open upper end connected to one of said first plurality of openings in said top end wall of said tank, and a second leg portion extending upwardly from said curved lower end and having an open upper end connected to one of said second plurality of openings in said top end wall of said tank; and heating means operative to sequentially flow hot combustion gases downwardly into the open upper ends of one of the pluralities of first and second leg portions of said U-tube immersion heating members, through said U-tube immersion heating members, and then upwardly through the open upper ends of the other of the pluralities of first and second leg portions of said U-tube immersion heating members.

10. The down-fired water heater of claim 9 wherein said heating means include:

a plurality of fuel burners positioned above the open upper ends of said first leg portions of said U-tube immersion heating members and operative to direct flames, and resulting hot combustion gases, into said first leg portions through the open upper ends thereof, and a draft inducer fan having an inlet operatively coupled to the open upper ends of said second leg portions of said U-tube immersion heating members.

11. The down-fired water heater of claim 10 wherein:

said fuel burners are shot-type fuel burners extending downwardly into the open upper ends of said first leg portions of said U-tube immersion heating members.

12. The down-fired water heater of claim 9 wherein said heating means include:

a plurality of air-driven forced draft fuel burners positioned above the open upper ends of said second leg portions of said U-tube immersion heating members and operative to force flames, and resulting hot combustion gases, into said second leg portions through the open upper ends thereof, and a burner supply air fan having an outlet operatively coupled to said fuel burners.

13. The down-fired water heater of claim 9 wherein:

each of said U-tube immersion heating members is formed from a single length of metal tubing.

14. The down-fired water heater of claim 13 wherein:

each length of metal tubing has a generally circular cross-section along its length.

* * * * *

UNITED STATES PATENT AND TRADEMARK OFFICE

CERTIFICATE OF CORRECTION

PATENT NO. : 5,207,211

DATED : May 4, 1993

INVENTOR(S) : David M. Hanning and Gordon W. Stretch

It is certified that error appears in the above-identified patent and that said Letters Patent is hereby corrected as shown below:

Column 2, line 18, "tan" should be --tank--.

Column 2, line 20, should read as follows --illustrated in the 1945 U.S. Pat. No. 2,543,835 to Dewey, is--.

Column 2, line 59, "ti" should be --to--.

Column 4, line 8, "2=2" should be --2-2--.

Column 4, line 32, "space" should be --spaced--.

Signed and Sealed this

Twenty-second Day of March, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,207,211

DATED : May 4, 1993

INVENTOR(S) : David M. Hanning and Gordon W. Stretch

It is certified that error appears in the above-indentified patent and that said Letters Patent is hereby corrected as shown below:

Column 6, line 48, insert --along-- between "extending" and "a".

Column 7, line 51, "first" should be --second--.

Signed and Sealed this

Sixth Day of January, 1998

*Attest:*

*Attesting Officer*

BRUCE LEHMAN

*Commissioner of Patents and Trademarks*